US006863009B1

(12) United States Patent
Driver

(10) Patent No.: US 6,863,009 B1
(45) Date of Patent: Mar. 8, 2005

(54) COMPOSITE RUB RAIL FOR WATERCRAFT, AND METHOD OF INSTALLING SAME

(76) Inventor: Lowell T. Driver, 2900 Boyne Rd., Marlette, MI (US) 48453-0368

( * ) Notice: Subject to any disclaimer, the term of this patent is extended or adjusted under 35 U.S.C. 154(b) by 0 days.

(21) Appl. No.: 10/422,114

(22) Filed: Apr. 24, 2003

(51) Int. Cl.[7] ..... B63B 59/02
(52) U.S. Cl. ..... 114/219
(58) Field of Search ..... 114/219, 343, 114/361, 364; 293/102, 126; 428/31; 411/43, 55, 84, 378, 904; 403/197

(56) References Cited

U.S. PATENT DOCUMENTS

| | | | | |
|---|---|---|---|---|
| 3,065,724 A | | 5/1959 | Tritt | |
| 2,959,146 A | * | 11/1960 | Erkert | 114/219 |
| 2,990,802 A | * | 7/1961 | Ong et al. | 114/219 |
| 3,019,758 A | * | 2/1962 | Erkert | 114/219 |
| 3,288,512 A | * | 11/1966 | Zientara | 411/84 |
| 3,388,523 A | * | 6/1968 | Evans | 428/31 |
| 3,897,967 A | * | 8/1975 | Barenyi | 114/219 |
| 4,083,592 A | * | 4/1978 | Rubin et al. | 428/31 |
| 4,084,533 A | | 4/1978 | Boyer | |
| 4,095,831 A | * | 6/1978 | Hagiwara et al. | 293/126 |
| 4,292,913 A | * | 10/1981 | Siebert et al. | 114/219 |
| 4,557,649 A | * | 12/1985 | Jeal | 411/40 |
| 4,579,493 A | | 4/1986 | Schaty | |
| 4,740,123 A | * | 4/1988 | Wollar et al. | 411/38 |
| 4,808,451 A | * | 2/1989 | McCue et al. | 428/31 |
| 4,911,971 A | * | 3/1990 | McCue et al. | 428/99 |
| 4,976,578 A | * | 12/1990 | Mathes et al. | 411/512 |
| 5,096,753 A | * | 3/1992 | McCue et al. | 428/31 |
| 5,149,569 A | * | 9/1992 | McCue | 428/31 |
| 5,152,648 A | * | 10/1992 | Pratt | 411/43 |
| 5,291,639 A | | 3/1994 | Baum et al. | |
| 5,468,108 A | | 11/1995 | Sullivan et al. | |
| 5,730,077 A | * | 3/1998 | Nunes et al. | 114/219 |
| 5,829,378 A | * | 11/1998 | Nunes et al. | 114/219 |
| 5,907,891 A | | 6/1999 | Meyer | |
| 5,955,147 A | | 9/1999 | Serafin | |
| 6,349,662 B1 | * | 2/2002 | Limansky et al. | 114/219 |

OTHER PUBLICATIONS

Barbour Plastics, Inc. Rigid & Flexible Rubrail Combinations, Semi–Rigid Rubrails, Rigid Rub Rails with Flexible Inserts.

* cited by examiner

*Primary Examiner*—Lars A. Olson
(74) *Attorney, Agent, or Firm*—Carrier, Blackman & Associates, P.C.; William D. Blackman; Joseph P. Carrier

(57) ABSTRACT

A composite rub rail includes an elongated base strip and an elongated center member which fits engagingly into the base strip. The base strip is made of a flexible plastic or elastomeric material, and has a shallow recessed groove formed centrally therein. The center member may be formed from a material which is more rigid than the material of the base strip. The center member includes a cover strip dimensioned to fit in the shallow recessed groove of the base strip. The cover strip may be made of stainless steel. The center member includes at least one fastener attached to and extending away from an inner surface of the cover strip, for operatively engaging the base strip, and for use in attaching the center member in fixed relation to the base strip. A method of attaching a rub rail to a boat is also described.

26 Claims, 7 Drawing Sheets

COMPOSITE RUB RAIL FOR WATERCRAFT, AND METHOD OF INSTALLING SAME

BACKGROUND OF THE INVENTION

1. Field of the Invention

The present invention relates to rub rails, for use on watercraft. More particularly, the present invention relates to a composite rub rail, including a central fastener-concealing strip. The invention also relates to methods of installing the described rub rail on watercraft.

2. Description of the Background Art

A number of different designs are known for marine rub rails. Examples of some of the known rub rails include U.S. Pat. No. 2,959,146 to Erkert, U.S. Pat. No. 1,887,881 to Blattner, U.S. Pat. No. 3,065,724 to Tritt, U.S. Pat. No. 4,084,533 to Boyer, U.S. Pat. No. 4,292,913 to Siebert et al, and U.S. Pat. No. 5,730,077 to Nunes et al.

A reflective aluminum trim which is usable in automobiles, trucks, boats and appliances, as well as a method of making the aluminum trim are disclosed in U.S. Pat. No. 5,955,147 to Serafin.

Many different types of fasteners are known. Examples of some known fasteners can be found in U.S. Pat. Nos. 4,579,493, 5,291,639, 5,468,108, and 5,907,891.

Although the known rub rails have some utility for their intended purposes, a need still exists in the art for an improved marine rub rail. In particular, there is a need for a marine rub rail which will more effectively conceal the attachment hardware used to connect it to a boat.

SUMMARY OF THE INVENTION

The present invention provides a composite rub rail, including an elongated base strip and an elongated center member which fits engagingly into the base strip.

The base strip is made of a flexible plastic or elastomeric material, and has a wide, shallow groove formed centrally therein, defining a pair of spaced-apart recessed ledges for supporting the outer edges of the center member. The base strip also has a secondary groove formed therein in a central portion of the shallow groove.

In a first illustrative embodiment, the base strip also includes an integral protruding rib extending outwardly thereon from a central portion of the secondary groove.

The center member includes a cover strip, dimensioned to fit in and/or substantially cover the shallow recessed groove of the base strip, and at least one fastener attached to and extending away from an inner surface of the cover strip. The fastener portion of the center member is provided for operatively engaging the base strip, and for use in attaching the center member in fixed relation to the base strip. The center member is formed from a material which is more rigid than the material of the base strip.

Additional hardware may be provided to help fasten the rub rail to a substrate, such as a boat.

The present invention also relates to a method of attaching a rub rail to a boat.

One illustrative method according to the invention includes a fast step of attaching a base strip to a boat, in which the base strip is made of a flexible plastic or elastomeric material, and has a shallow recessed groove formed centrally therein.

The method includes a subsequent step of placing an elongated center member into the shallow recessed groove of the base strip, in which the center member includes a cover strip which is dimensioned to fit in and/or substantially cover the shallow recessed groove of the base strip, and at least one fastener attached to and extending away from an inner surface of the cover strip.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Referring now to FIGS. 1–4, the present invention provides a composite rub rail 20, for installing on the side of a boat B to protect the boat's structure and finish during minor low-speed contact with pilings, other boats etc.

Overview

Figure 1:
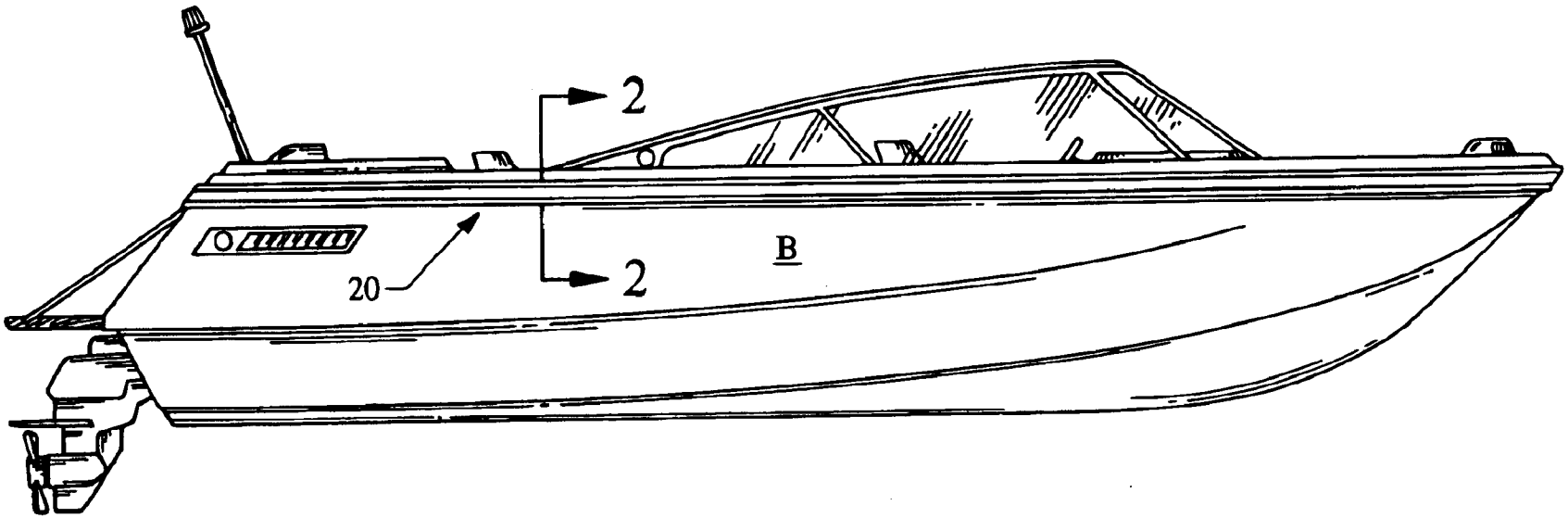
FIG. 1 is a side plan view of a boat with a rub rail installed thereon.
Figure 2A:
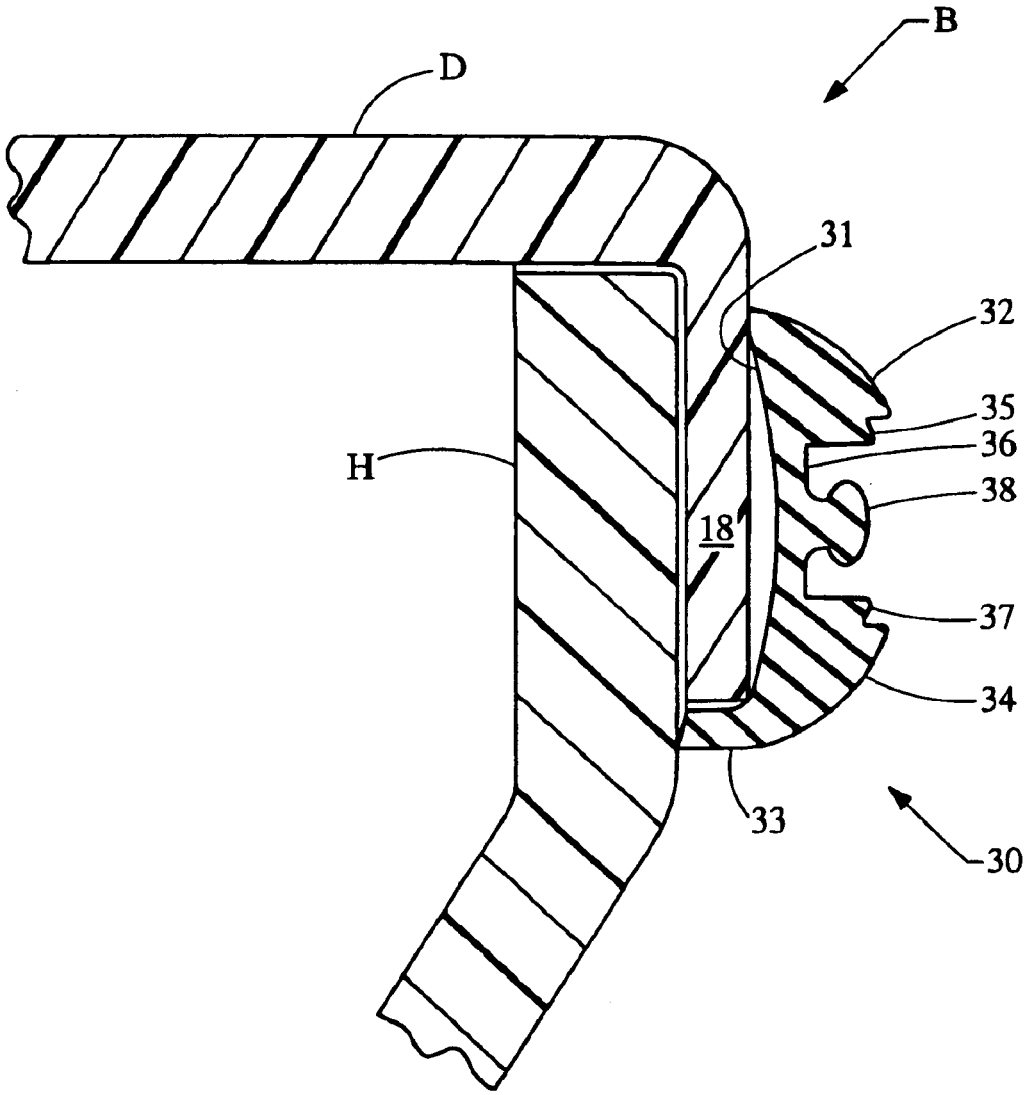
FIG. 2A is a cross-sectional detail view of a portion of the boat of FIG. 1, taken along the line 2—2 thereof and showing a rub rail according to a first embodiment of the invention, with the rub rail center member deleted from the illustration for discussion purposes.
Figure 2B:
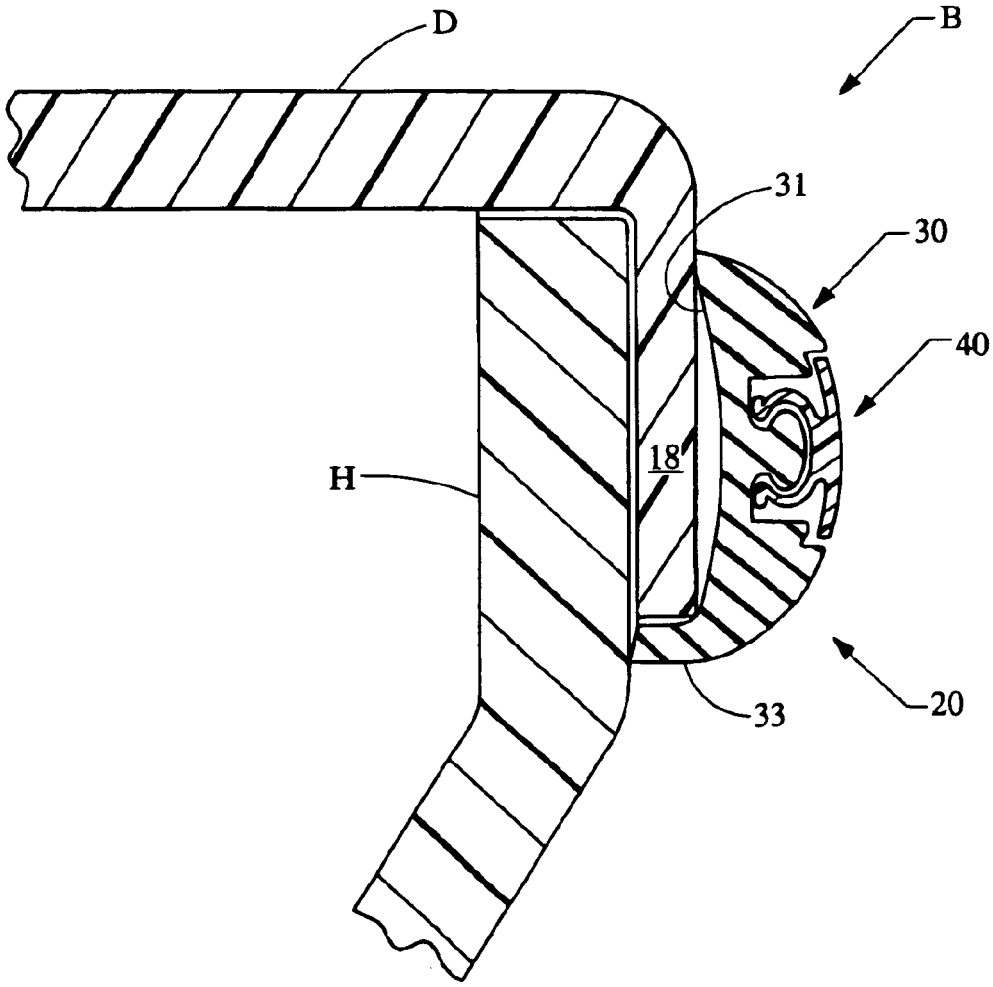
FIG. 2B is a view similar to FIG. 2A, with the center member added.
Figure 3:
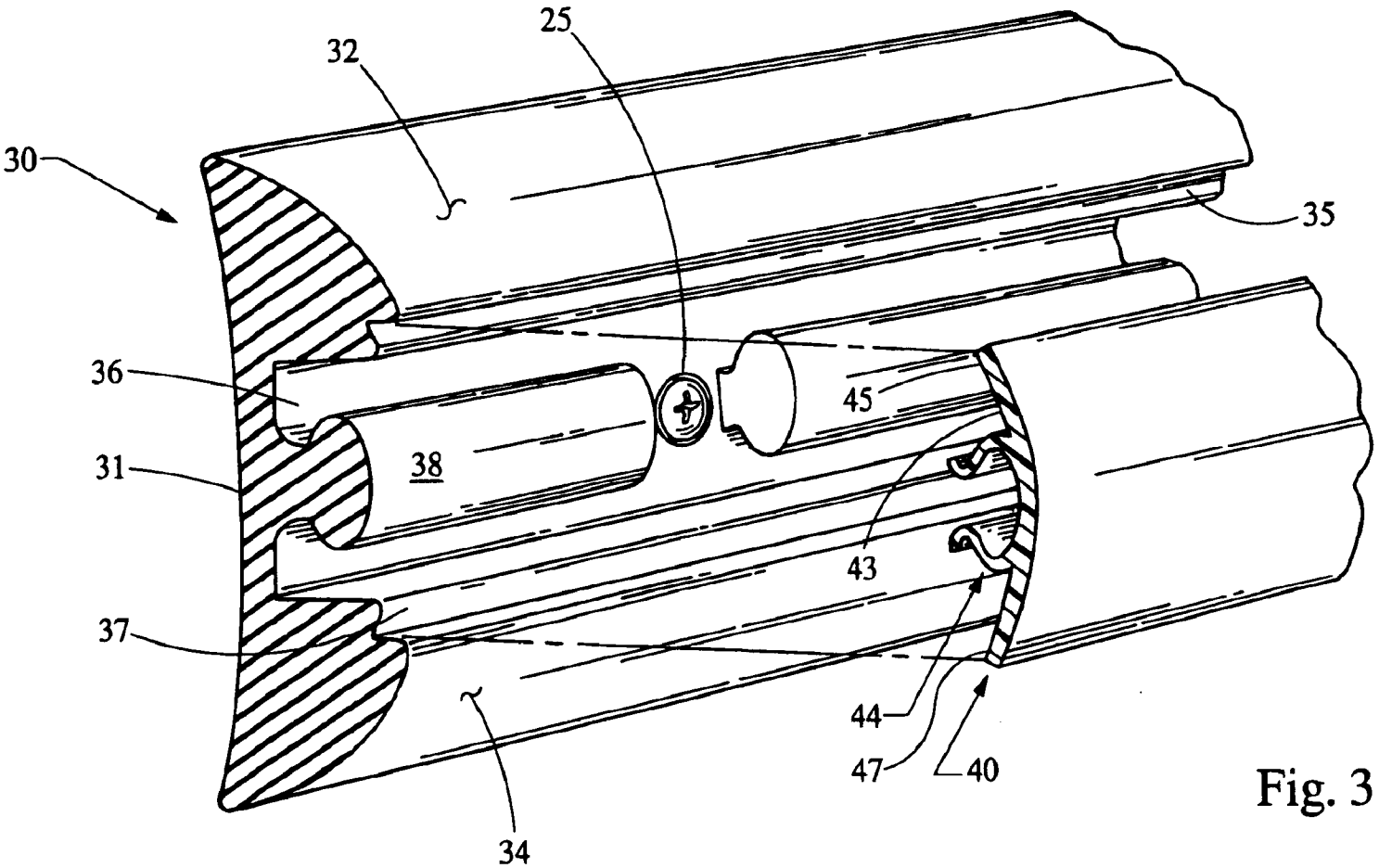
FIG. 3 is an exploded perspective view of the rub rail of FIG. 2.

As seen best in FIGS. 2A–2B and 3, a composite rub rail 20, according to a first embodiment of the invention, includes an elongated base strip 30. The rub rail 20 also includes an elongated center member 40, which fits engagingly into the base strip 30, and which effectively covers fasteners, such as screws 25 (FIG. 3), which are used to attach the base strip to the outer surface of the boat B.

The rub rail 20 is attached to the boat B at the point where the boat's deck D is joined to the hull H. Conventional fasteners such as screws 25 are passed through spaced-apart central holes in the base strip 30, through a side flange 18 of the deck D, and are then threadably fastened or otherwise affixed to the upper section of the hull H.

Alternatively, the rub rail 20 may be fastened only to the deck flange 18 or only to the hull H, depending on a particular application thereof.

As another option in attaching the rub rail 20 to the boat B, a reliable water-resistant marine adhesive may be used to affix the base strip 30 to a selected portion of the boat.

The Base Strip

The base strip 30 is one of the primary components of the rub rail 20, and is provided as a non-rigid resilient or semi-resilient cushioning member for minimizing damage, such as nicks and/or scratches, which otherwise might be caused when the side of the boat B contacts another solid mass, such as another boat, a pier, or a portion of a dock.

The base strip 30 is made of a relatively flexible plastic or elastomeric material, which may be vinyl or a vinyl polymer. The base strip 30 is formed as a continuous, extruded member, and may be cut to length to fit a particular application.

The base strip 30 has a substantially flattened inner surface 31 for contacting a side surface of the boat B, such as a dependent side flange 18 of the deck D.

The base strip 30 may include an integrally-formed lower extension flange 33, for extending inwardly below the bottom edge of the deck D, as shown in FIGS. 2A-2B. The lower extension flange 33 is omitted from the drawing of FIG. 3 for purposes of simplicity in illustration.

The base strip 30 also includes a first side edge 32 and a second side edge 34 opposite the first side edge. The base strip 30 has a wide, shallow groove formed centrally therein, between the first and second side edges 32, 34. The wide, shallow groove defines first and second recessed ledges 35, 37 for supporting the respective outer edges 45, 47 of the center member 40.

In the embodiment of FIGS. 2–4, the base strip 30 also has a secondary groove 36 formed therein which is deeper than the shallow groove, and extends into the body of the base strip beyond the ledges 35, 37.

In the embodiment of FIGS. 2–3, an integral protruding rib 38 is also provided as part of the base strip, extending outwardly from the central portion of the secondary groove 36. Where used, the protruding rib 38 is interrupted and cut away at predetermined intervals, to provide access to mounting holes and to receive mounting hardware such as screws 25 in the base strip 30.

The Center Member

The center member 40 makes up the second primary component of the rub rail 20 according to the present invention. The center member 40 provides the advantage of concealing the screws 25 or other fasteners which are used to affix the rub rail 20 to the boat B.

While the base strip 30 attaches firmly and directly to the boat B, in this first embodiment, the center member 40 attaches only to the base strip. Therefore, in the embodiment of FIGS. 2–4, the center member 40 is only indirectly attached to the boat B.

The center member 40 is formed from a material which is more rigid than the material of the base strip 30. The center member 40 may be formed from a tough, resilient plastic such as a polyacetal, KEVLAR or MYLAR, or may be formed from a metal. (KEVLAR and MYLAR are registered trademarks of E.I. du Pont de Nemours and Company of Wilmington, Del.).

Examples of metals which are usable for the center member 40 include aluminum and stainless steel. Stainless steel is a preferred material for the center member 40.

Where plastic is used for the center member 40, the colors of the base strip 30 and center member 40 may be chosen to compliment one another, and to coordinate with and match the color of the boat B, for enhanced visual appeal. The center member 40 includes a cover strip 42, dimensioned to fit in and/or substantially cover the shallow recessed groove of the base strip, and at least one fastener 44 attached to and extending away from an inner surface 43 of the cover strip. The cover member 40, in the embodiment of FIG. 4A uses a plurality of flexible spaced-apart U-shaped clips, such as those shown at 44 and 46. The free ends of the clips curve inwardly toward one another and then outwardly away, as shown. in order to help retain the clips in place on the protruding rib, which has a corresponding shape with a narrow neck portion and an enlarged head portion.

Where the cover strip 42 is formed from stainless steel, the clips 44, 45 may also be made of stainless steel, and may be welded to the cover strip in appropriate fashion. Where the cover strip 42 is formed from a plastic material, the clips 44, 45 may be integrally formed therewith.

The fastener(s) 44, 45 are provided for operatively engaging the base strip 30, and for use in attaching the center member 40 in fixed relation to the base strip. In the embodiment of FIGS. 2–4A, the fasteners 44, 45 clip on to and connect to the protruding rib 38 of the base strip 30.

Additional hardware, such as screws 25, rivets or other conventional fasteners may be provided to help fasten the rub rail to a substrate, such as a boat.

The cover strip 42 may be slightly curved in cross-section, as shown in the drawings, to smoothly align with the exterior shape of the base member 30 and to cooperate therewith to form a rub rail 40 which is substantially D-shaped in cross-section, with the shape modified by the flange 33 at the bottom thereof.

Figure 4A:
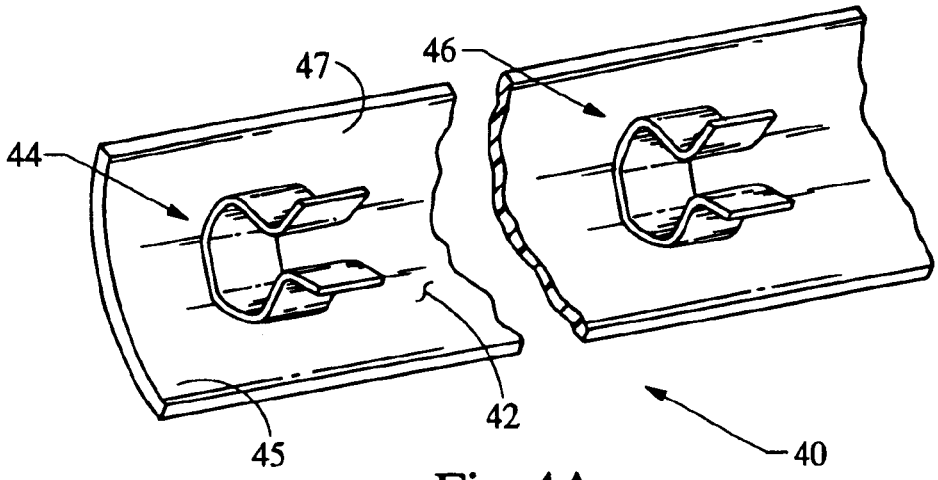
FIG. 4A is a perspective view of the inside surface of a center member which is a component of the rub rail of FIG. 3.
Figure 4B:
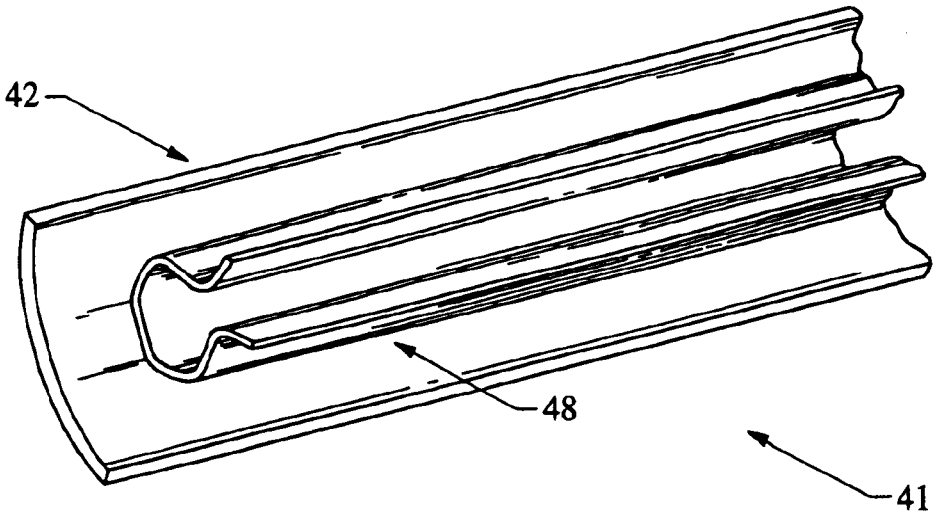
FIG. 4B is similar to FIG. 4A, and shows a modified version of the center member thereof.

Referring now to FIG. 4B, an alternative structure for the center member 40 is shown, in which a single extended-length fastening clip 48 extends across all or most of the inside surface of the cover strip 42. The cover strip 42, in the modified embodiment of FIG. 4B, is identical to the cover strip 42 in the embodiment of FIG. 4A.

The present invention also relates to a method of attaching a rub rail to a boat.

One illustrative method according to the invention includes a first step of attaching a base strip to a boat, in which the base strip is made of a flexible plastic or elastomeric material, and has a shallow recessed groove formed centrally therein.

The method includes a subsequent step of placing an elongated center member into the shallow recessed groove of the base strip, in which the center member includes a cover strip which is dimensioned to fit in the shallow recessed groove of the base strip, and at least one fastener attached to and extending away from an inner surface of the cover strip.

Second Embodiment

Figure 5:
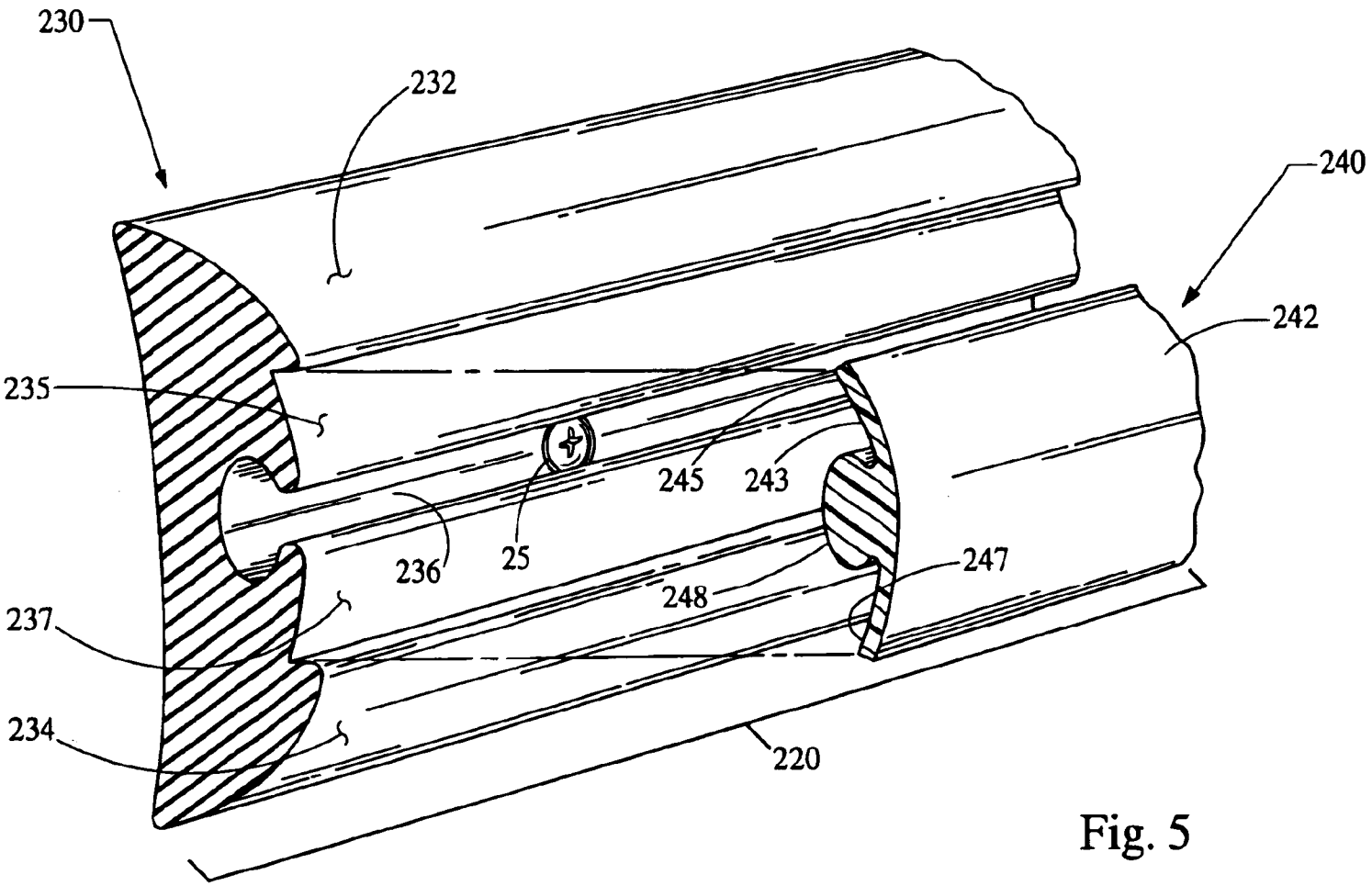
FIG. 5 is an exploded perspective view similar to FIG. 3, showing a rub rail according to a second embodiment of the invention.

Referring now to FIG. 5, a rub rail 220 according to a second embodiment of the invention is shown. The rub rail 220 has many features in common with the rub rail 20 of the first embodiment. Selected features of the rub rail 220 are specifically described herein as being different from features of the rub rail 20. However, features of the rub rail 220 which are not specifically described as different from the first embodiment will be understood to be similar or identical to that described herein in connection with the rub rail 20 of the first embodiment.

In the embodiment of FIG. 5, the rub rail includes a base strip 230 and a center member 240 which can be removably placed into cooperative engagement with the base strip 230.

The Base Strip

The base strip 230 is formed from a flexibly resilient material, similar to the base strip 30 of the first embodiment.

In this second embodiment, the base strip 230 includes a first side edge 232 and a second side edge 234 opposite the first side edge. The base strip 230 has a wide, shallow groove formed centrally therein, between the first and second side edges 232, 234. The wide, shallow groove defines first and second recessed ledges 235, 237 for supporting the respective outer edges 245, 247 of the center member 240.

In the embodiment of FIG. 5, the base strip 230 also has a secondary groove 236 formed centrally therein, which is deeper than the shallow groove. The secondary groove 236 extends into the body of the base strip 230 beyond the ledges 235, 237, as shown, and has a cross-sectional shape resembling a jigsaw-puzzle slot, as shown.

The Center Member

The center member 240 makes up the second primary component of the rub rail 220 according to the present invention. The center member 240 provides the advantage of concealing the screws 25 or other fasteners which are used to affix the rub rail 220 to the boat B.

While the base strip 230 attaches firmly and directly to the boat B, in this second embodiment, the center member 240 attaches only to the base strip. Therefore, in the embodiment of FIG. 5, the center member 240 is only indirectly attached to the boat B.

The center member 240 is formed from a material which is more rigid than the material of the base strip 230. The center member 240 is formed from similar material to that described in connection with the center member 40 of the first embodiment.

The center member 240 includes a cover strip 242, dimensioned to fit in the shallow recessed groove of the base strip. The center member 242 also includes at least one fastener attached to and extending away from an inner surface 243 of the cover strip 242. The cover member 240, in the embodiment of FIG. 5, uses a single fastener in the form of an integral protruding rib 248, extending outwardly away from the central portion of the cover strip inner surface 243. The protruding rib 248 has a cross-sectional shape resembling a jigsaw-puzzle tab, as shown.

The protruding rib 248 is provided for operatively engaging the base strip 230, and for use in attaching the center member 240 in fixed relation to the base strip. In the embodiment of FIG. 5, the protruding rib 248 can be forced into the secondary groove 236 of the base strip 230, to temporarily retain the center member in engagement therewith.

As an alternative to a single extended-length protruding rib, a plurality of spaced-apart sections, corresponding in shape to the protruding rib, can be used on the inner surface 243 of the cover strip 242.

Third Embodiment

Figure 6:
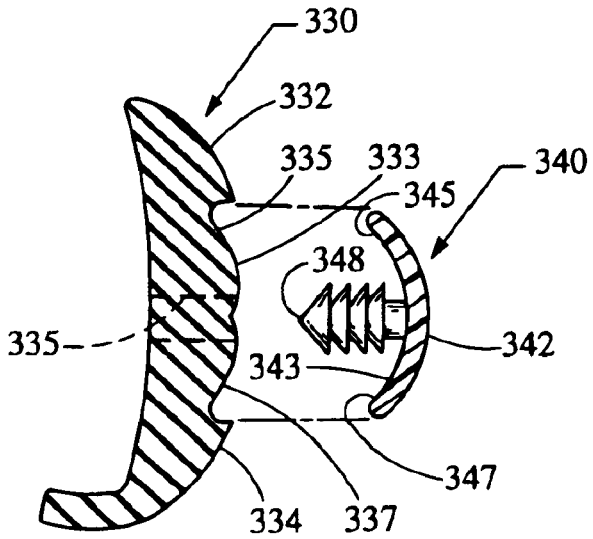
FIG. 6 is an exploded side plan view of a rub rail according to a third embodiment of the invention.
Figure 7:
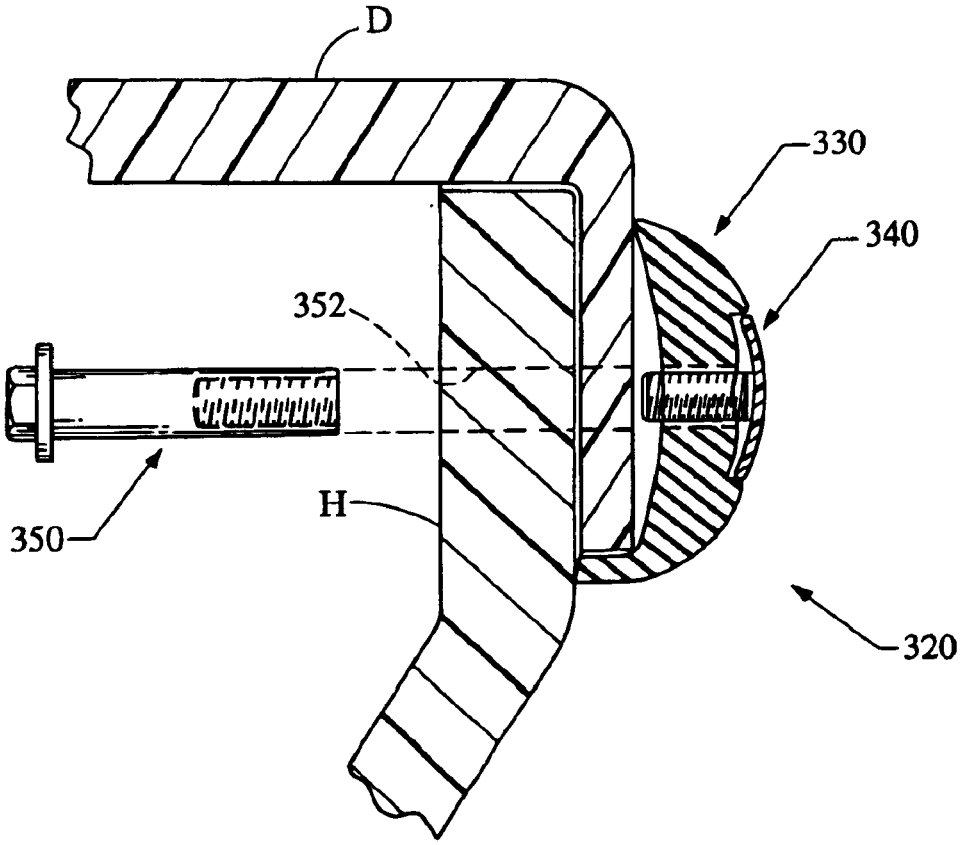
FIG. 7 is a cross-sectional view similar to FIG. 2, and showing an optional auxiliary fastener that is usable with the rub rail of FIG. 6.

Referring now to FIGS. 6–7, a rub rail 320 according to a third embodiment of the invention is shown. The rub rail 320 has many features in common with the rub rail 20 of the first embodiment. Selected features of the rub rail 320 are specifically described herein as being different from features of the rub rail 20. However, features of the rub rail 320 which are not specifically described as different from the first embodiment will be understood to be similar or identical to that described herein in connection with the rub rail 20 of the first embodiment.

In the embodiment of FIGS. 6–7, the rub rail includes a base strip 330 and a center member 340 which can be removably placed into cooperative engagement with the base strip 330. Optionally, at selected locations thereon, the rub rail 320 according to the third embodiment can be attached to the boat B from the inside of the hull H, using specialized hollow tubular bolts 350.

The Base Strip

The base strip 330 is formed from a flexibly resilient material, similar to the base strip 30 of the first embodiment.

In this third embodiment, the base strip 330 includes a first side edge 332 and a second side edge 334 opposite the first side edge. The base strip 330 has a wide, shallow groove 333 formed centrally therein, between the respective first and second side edges 332, 334. The wide, shallow groove 333 defines first and second recessed ledges 335, 337 for supporting the respective outer edges 345, 347 of the center member 340.

In the embodiment of FIGS. 6–7, the base strip 330 also has a plurality of spaced-apart hollow cylindrical bores 335 formed centrally therein, which are deeper than the shallow groove 333. The hollow bores 335 extend into the body of the base strip 330 beyond the ledges 335, 337, as shown.

The Center Member

The center member 340 makes up the second primary component of the rub rail 320 according to the third embodiment of the invention. The center member 340 provides the advantage of concealing the screws 25 and/or other fasteners which are used to affix the rub rail 330 to the boat B.

While the base strip 330 may be attached firmly and directly to the boat B by screws 25 or other suitable fasteners, in this third embodiment, the center member 340 may also be attached directly to the boat hull H, using a plurality of specialized hollow tubular bolts 350, having a hollow bore formed therein with internal threading in the hollow bore, as will be further described.

The center member 340 is formed from a material which is more rigid than the material of the base strip 330. The center member 340 is formed from similar material to that described in connection with the center member 40 of the first embodiment, and may be formed of stainless steel.

The center member 340 includes a cover strip 342, dimensioned to fit in the shallow recessed groove 333 of the base strip. The center member 342 also includes at least one fastener attached to and extending away from an inner surface 343 of the cover strip 342.

In the embodiment of FIGS. 6–7, the cover member 340 uses a plurality of fasteners in the form of spaced-apart integral protruding "fir tree" studs 348, extending outwardly away from the central portion of the cover strip inner surface 343.

In a case where the cover member 340 is formed from a plastic material, the fir tree studs 348 may be plastic studs, having flexibly deformable vanes extending outwardly thereon.

Alternatively, in a case where the cover member 340 is formed from stainless steel, the fir tree studs may be stainless steel studs which are externally threaded. Where metal studs are used, they are welded on to the inner surface 343 of the cover strip 342. In selected high-stress locations, appropriate holes 352 may be drilled through the boat deck D and hull H. Then, a specialized hollow tubular bolt 350 can be fed through the holes 352 from inside of the boat B, and can be threadably tightened down on the stud 348.

Although the present invention has been described herein with respect to a limited number of presently contemplated embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A composite rub rail, comprising:

an elongated base strip, comprising a plastic or elastomeric material and having a first side edge, a second side edge opposite the first side edge, and a recessed groove between said side edges defining first and second ledges; and an elongated center member, comprising a cover strip dimensioned to substantially cover said recessed groove of said base strip, said cover strip having an outer surface and an inner surface, and at least one fastener attached to and extending away from said inner surface of said cover strip, for operatively engaging said base strip and for use in attaching said center member to said base strip;

wherein the outer surface of the cover strip extends outwardly beyond the base strip when the center member is installed on the base strip.

2. The rub rail of claim 1, wherein the center member is formed from a material which is more rigid than the material of the base strip.

3. The rub rail of claim 2, wherein the center member comprises a polyacetal.

4. The rub rail of claim 2, wherein the center member comprises a metal.

5. The rub rail of claim 2, wherein the center member comprises stainless steel.

6. The rub rail of claim 1, wherein said base strip has a plurality of mounting holes formed therein in communication with said recessed groove.

7. The rub rail of claim 1, wherein said at least one fastener comprises a plurality of studs for placement in holes formed in said base strip.

8. The rub rail of claim 7, wherein said center member comprises a metal, wherein said studs are welded on to said cover strip, and further comprising a plurality of hollow tubular fasteners having female threads formed internally therein for engaging selected studs to fasten said rub rail to a substrate.

9. The rub rail of claim 7, wherein said studs are formed from plastic material have deformable vanes extending outwardly thereon, and are integrally formed with said cover strip.

10. The rub rail of claim 1, wherein said at least one fastener comprises a plurality of substantially U-shaped clips.

11. A boat having the rub rail of claim 1 installed thereon.

12. A composite rub rail, comprising:

an elongated base strip, comprising a plastic or elastomeric material and having a first side edge, a second side edge opposite the first side edge, and a recessed groove between said side edges, said base strip further having an integral raised rib in said recessed groove; and an elongated center member formed from a material which is more rigid than the material of the base strip, said center member being attachable to said base strip and comprising a cover strip dimensioned to substantially cover said recessed groove of said base strip, said cover strip having an outer surface and an inner surface, and at least one substantially U-shaped clip attached to and extending away from said inner surface, for operatively engaging said base strip and for use in attaching said center member to said base strip;

wherein the outer surface of the cover strip extends outwardly beyond the base strip when the center member is installed on the base strip.

13. The rub rail of claim 12, wherein the center member comprises a metal.

14. The rub rail of claim 13, wherein the center member comprises stainless steel.

15. The rub rail of claim 12, wherein the center member comprises a polyacetal.

16. A method of attaching a rub rail to a boat, comprising the steps of:

a) attaching a base strip to a boat, wherein the base strip is made of a plastic or elastomeric material, and has a shallow groove formed centrally therein; and b) operatively attaching an elongated center member to the base strip, wherein said center member comprises a cover strip which is dimensioned to fit in the shallow recessed groove of the base strip, and at least one fastener attached to and extending away from an inner surface of the corner strip, for engaging the base strip;

wherein the outer surface of the cover strip extends outwardly beyond the base strip when the center member is installed on the base strip.

17. The method of claim 16, wherein said at least one fastener comprises a plurality of spaced-apart clips having a substantially U-shaped cross section.

18. The method of claim 17, wherein the cover strip comprises stainless steel.

19. The method of claim 17, wherein said at least one fastener comprises at least one flexibly resilient clip having a substantially U-shaped cross section.

20. The method of claim 18, wherein said at least one fastener comprises a threaded metal stud.

21. The method of claim 17, wherein said at least one fastener comprises a plastic stud having a plurality of flexibly deformable vanes extending outwardly thereon.

22. The method of claim 17, wherein said at least one fastener comprises an integral protruding rib, attached to the cover strip, for placement in a central groove of the base strip.

23. A base strip for use as part of a marine rub rail, said base strip comprising an elongated strip body formed from a plastic or elastomeric material and having a first side edge, a second side edge opposite the first side edge, and a recessed groove between said side edges, said recessed groove having a floor;

said base strip further having an integral raised rib in said recessed grove, extending outwardly from the floor thereof, and wherein the raised rib includes a wide portion spaced away from the floor of said groove, and a narrow portion disposed inside of the wide portion.

24. A base strip for use as part of a marine rub rail, said base strip comprising:

an elongated strip body formed from a plastic or elastomeric material, said strip body having a shallow groove formed substantially centrally therein and defining a pair of spaced-apart recessed ledges for supporting a center member;

said strip body further having a secondary groove formed therein at a portion of the shallow groove, said secondary groove extending deeper into the strip body than the shallow groove; and an integral raised rib extending outwardly thereon at a portion of the secondary groove, and wherein the raised rib includes a wide portion spaced away from an inner part of the secondary groove, and a narrow portion disposed inside of the wide portion.

25. A composite rub rail, comprising:

an elongated base strip formed from a plastic material, said base strip having a first side edge, a second side edge opposite the first side edge, and a recessed groove between said side edges, said base strip further having an integral raised rib in said recessed groove; and an elongated center member comprising a material which is more rigid than the material of the base strip, said center member being attachable to said base strip and comprising:

a cover strip dimensioned to substantially cover said recessed groove of said base strip, said cover strip having an outer surface and an inner surface, and a plurality of fasteners attached to and extending away from said inner surface of said cover strip, for operatively engaging said base strip and for use in attaching said center member to said base strip;

wherein the outer surface of the cover strip extends outwardly beyond the base strip when the center member is installed on the base strip.

26. The rub of claim 25, wherein said base strip is further comprised of an elongated strip formed from a plastic or elastomeric material, said strip body having a shallow groove formed substantially centrally therein and defining a pair of spaced-apart recessed ledges for supporting a center member; said strip body further having a secondary groove formed therein at a portion of the shallow groove, said secondary groove extending deeper into the strip body than the shallow groove; and an integral raised rib extending outwardly thereon at a portion of the secondary groove.

* * * * *